US009847604B2

(12) United States Patent
Guo et al.

(10) Patent No.: US 9,847,604 B2
(45) Date of Patent: Dec. 19, 2017

(54) ELECTRICAL CONNECTOR HAVING IMPROVED SHIELDING STRUCTURE

(71) Applicant: FOXCONN INTERCONNECT TECHNOLOGY LIMITED, Grand Cayman (KY)

(72) Inventors: Jing-Jie Guo, Huaian (CN); Cai-Yun Zhang, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/344,820

(22) Filed: Nov. 7, 2016

(65) Prior Publication Data

US 2017/0133795 A1 May 11, 2017

(30) Foreign Application Priority Data

Nov. 5, 2015 (CN) ..... 2015 1 0743677

(51) Int. Cl.

| | |
|---|---|
| ***H01R 24/00*** | (2011.01) |
| ***H01R 33/00*** | (2006.01) |
| ***H01R 13/6581*** | (2011.01) |
| ***H01R 13/405*** | (2006.01) |
| ***H01R 13/506*** | (2006.01) |
| ***H01R 13/627*** | (2006.01) |
| ***H01R 43/24*** | (2006.01) |
| ***H01R 13/6594*** | (2011.01) |

(52) U.S. Cl.

CPC ..... *H01R 13/6581* (2013.01); *H01R 13/405* (2013.01); *H01R 13/506* (2013.01); *H01R 13/6275* (2013.01); *H01R 13/6594* (2013.01); *H01R 43/24* (2013.01)

(58) Field of Classification Search

CPC ..... H01R 13/6597; H01R 13/6275; H01R 13/6582; H01R 13/6593; H01R 13/639; H01R 13/658

USPC ..... 439/660, 607.01, 607.35, 607.34, 607.19

See application file for complete search history.

(56) References Cited

U.S. PATENT DOCUMENTS

| | | | |
|---|---|---|---|
| 8,573,995 | B2 | 11/2013 | Golko et al. |
| 9,431,746 | B2 | 8/2016 | Wu et al. |
| 9,437,984 | B2 | 9/2016 | Golko et al. |
| 9,484,681 | B2 * | 11/2016 | Little ..... H01R 13/6597 |

(Continued)

*Primary Examiner* — Abdullah Riyami
*Assistant Examiner* — Thang Nguyen
(74) *Attorney, Agent, or Firm* — Wei Te Chung; Ming Chieh Chang

(57) ABSTRACT

An electrical connector includes an insulative housing, a number of terminals disposed in the insulative housing, a metallic shielding plate, and a shell. The insulative housing defines a base portion and a tongue portion extending upwardly from the base portion. The terminals have at least one grounding contact located laterally. The at least one grounding contact has a connecting portion retained in the base portion, a soldering portion extending backwardly from the base portion, and a tail portion extending upwardly from the connecting portion and exposed from a gap of the tongue portion. The metallic shielding plate has a bridge portion enclosing a front end of the tongue portion and a pair of side portions extending backwardly from two sides of the bridge portion. The side portions partly cover side edges of the tongue portion and electrically connect with the tail portions of the at least one grounding contact.

19 Claims, 15 Drawing Sheets

(56) References Cited

U.S. PATENT DOCUMENTS

| | | | | |
|---|---|---|---|---|
| 2013/0210261 | A1* | 8/2013 | Weber | H01R 43/26 439/358 |
| 2015/0126069 | A1 | 5/2015 | Little et al. | |
| 2015/0318646 | A1* | 11/2015 | Little | H01R 4/023 439/78 |
| 2016/0181733 | A1* | 6/2016 | Duan | H01R 13/6594 439/607.05 |
| 2017/0054258 | A1* | 2/2017 | Little | H01R 24/60 |

* cited by examiner

ELECTRICAL CONNECTOR HAVING IMPROVED SHIELDING STRUCTURE

BACKGROUND OF THE INVENTION

1. Field of the Invention

The present invention relates to an electrical connector, and more particularly to an electrical connector having an improved shielding structure.

2. Description of Related Art

U.S. Patent Application Publication No. 2015/0126069 discloses a flippable electrical connector including, among others, a metallic power/grounding contact or clip. The clip has a rear end terminated to a paddle card and a front end defining a pair of retention recesses for engagement with a pair of corresponding deflectable power/grounding contacts of a mating connector.

Hence, an improved electrical connector is desired.

SUMMARY OF THE INVENTION

Accordingly, the object of the present invention is to provide an electrical connector comprising: an insulative housing defining a base portion and a tongue portion; a plurality of terminals disposed in the insulative housing and including at least one grounding contact located laterally, the at least one grounding contact having a connecting portion retained in the base portion, a soldering portion extending backwardly from the base portion, and a tail portion extending from the connecting portion and exposed to a gap of the tongue portion; a metallic shielding plate affixed to a front end of the tongue portion, the metallic shielding plate having bridge portion enclosing a front end of the tongue portion and a pair of side portions extending backwardly from two sides of the bridge portion, the side portions partly covering side edges of the tongue portion and electrically connected with the tail portion of the at least one grounding contact; and a shielding shell attached to the insulative housing. Another object of the present invention is to provide a method of making such electrical connector.

Other objects, advantages and novel features of the invention will become more apparent from the following detailed description when taken in conjunction with the accompanying drawings.

DETAILED DESCRIPTION OF THE PREFERRED EMBODIMENT

Figure 1:
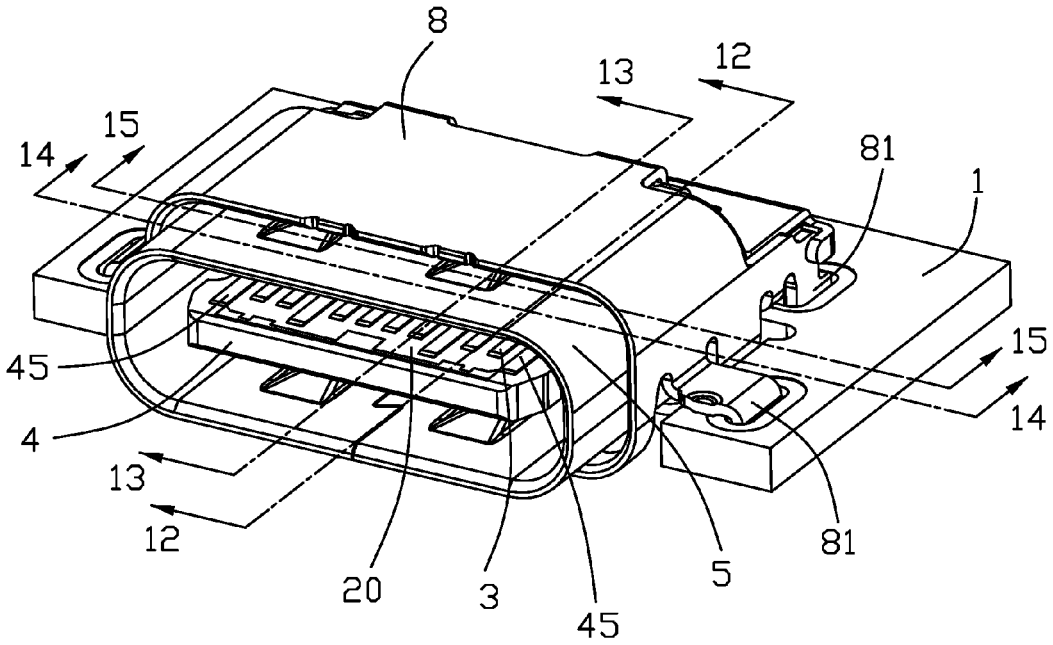
FIG. 1 is a perspective, assembled view of an electrical connector mounted upon a printed circuit board.
Figure 2:
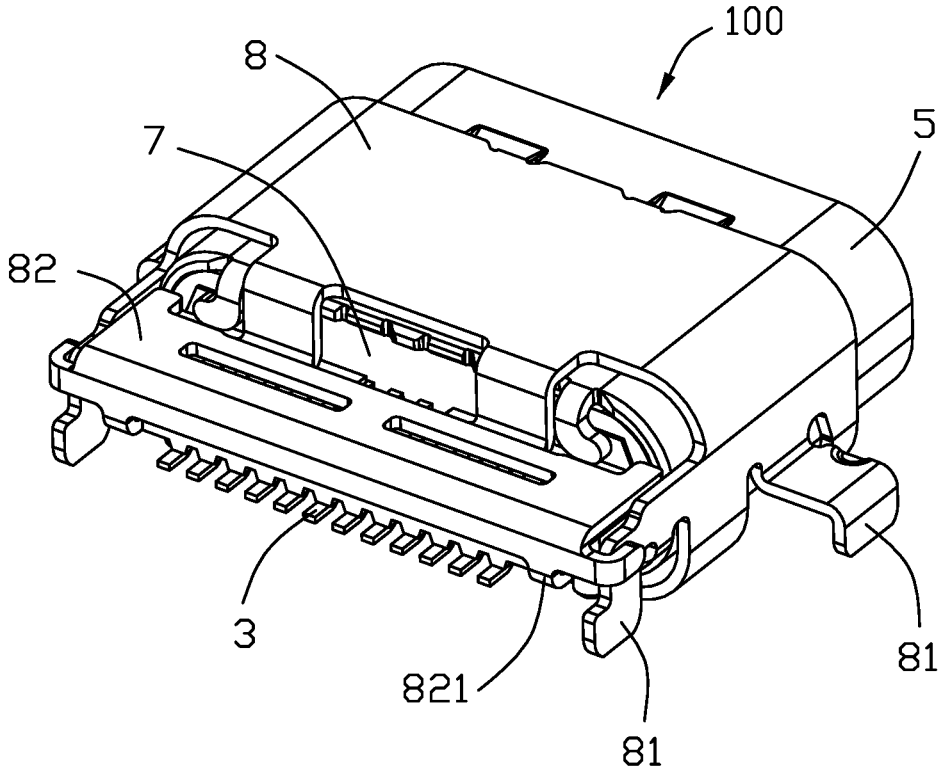
FIG. 2 is a perspective, assembled view of the electrical connector.
Figure 3:
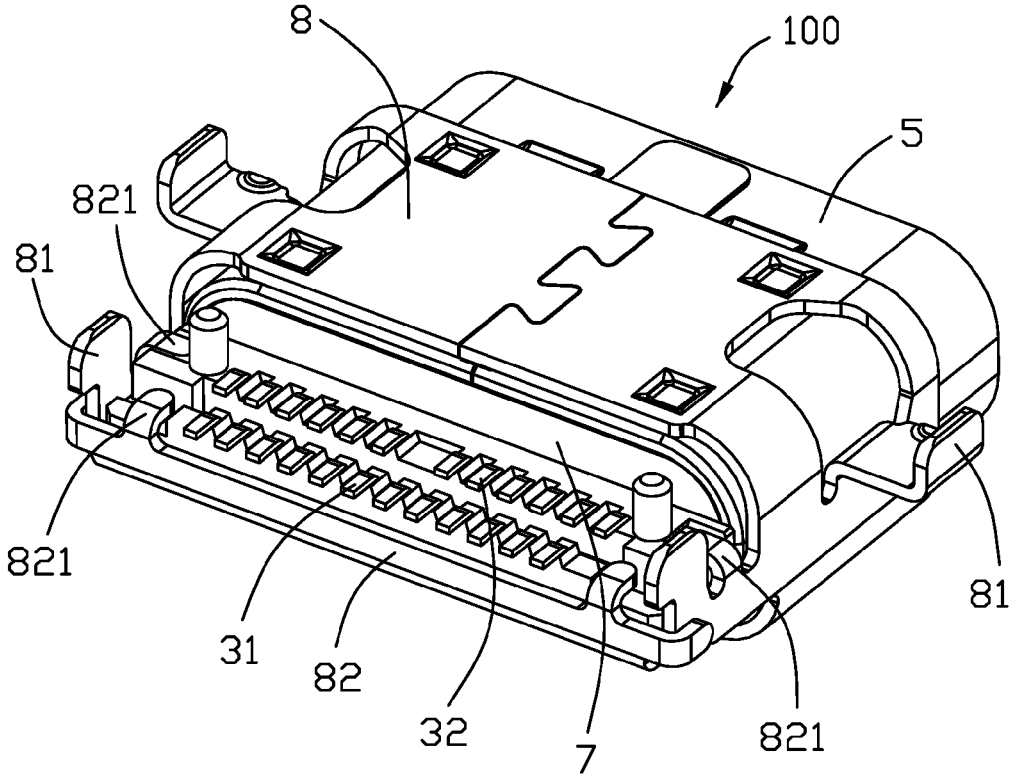
FIG. 3 is another view of the electrical connector of FIG. 2.
Figure 4:
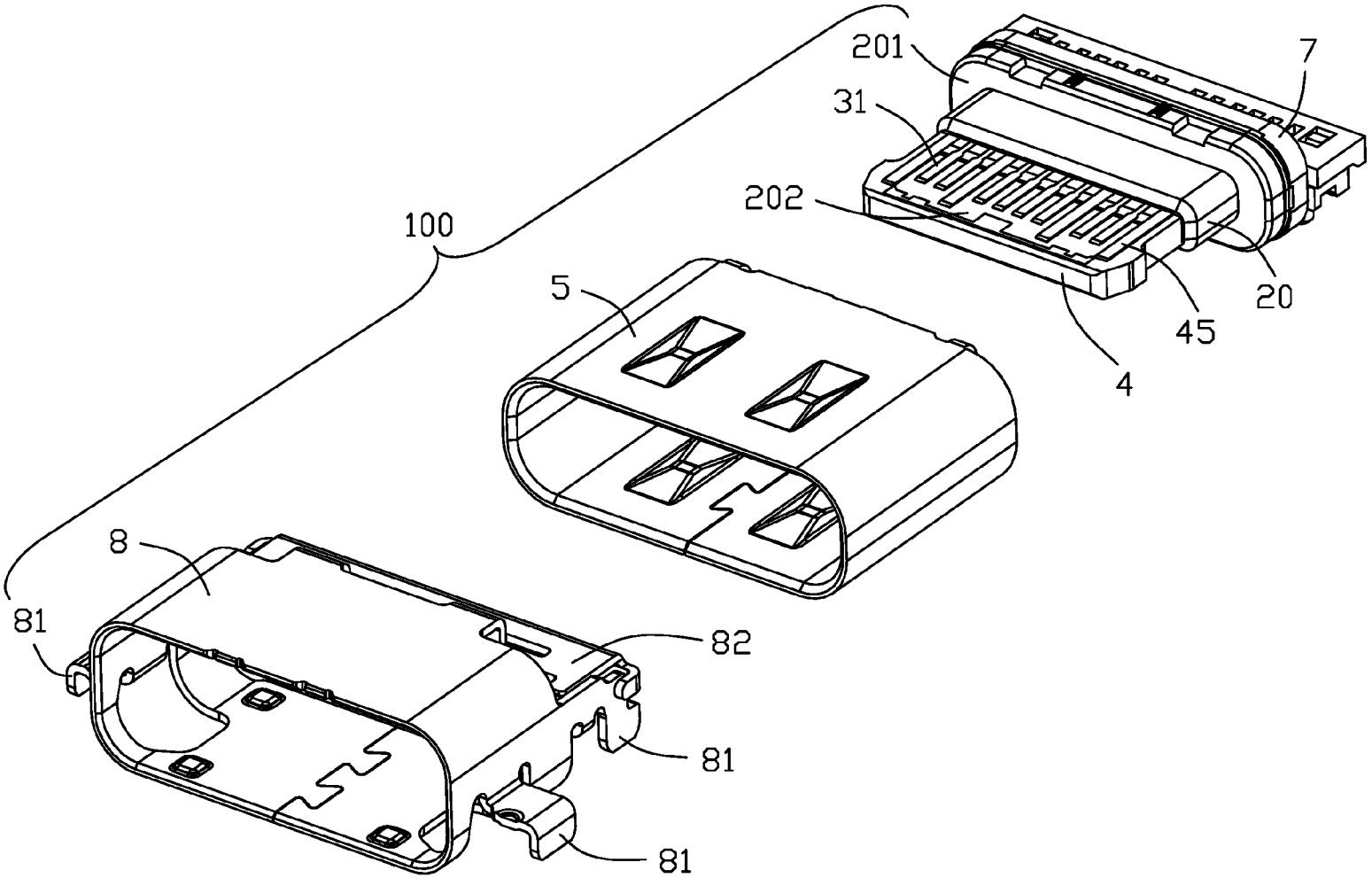
FIG. 4 is a perspective, partly exploded view of the electrical connector.

Reference will now be made in detail to the preferred embodiment of the present invention.

FIGS. 1-13 show an electrical connector 100. For convenience, the electrical connector 100 defines a mating direction, a transverse direction perpendicular to the mating direction, and a vertical direction perpendicular to the mating direction and the transverse direction. The electrical connector 100 defines a mating port mated with a mating connector.

The electrical connector 100, mounted upon a printed circuit board 1 in a sunk manner, includes an insulative housing 20, a number of terminals 3 and a metallic shielding/grounding/retaining plate or bracket 4 retained in the insulative housing 20, a shielding shell 5 formed with a mating cavity to receive the insulative housing 20, a sealer 7 sealing up a gap between the insulative housing 20 and the shielding shell 5, and a metal shell 8 attached to the shielding shell 5.

Figure 5:
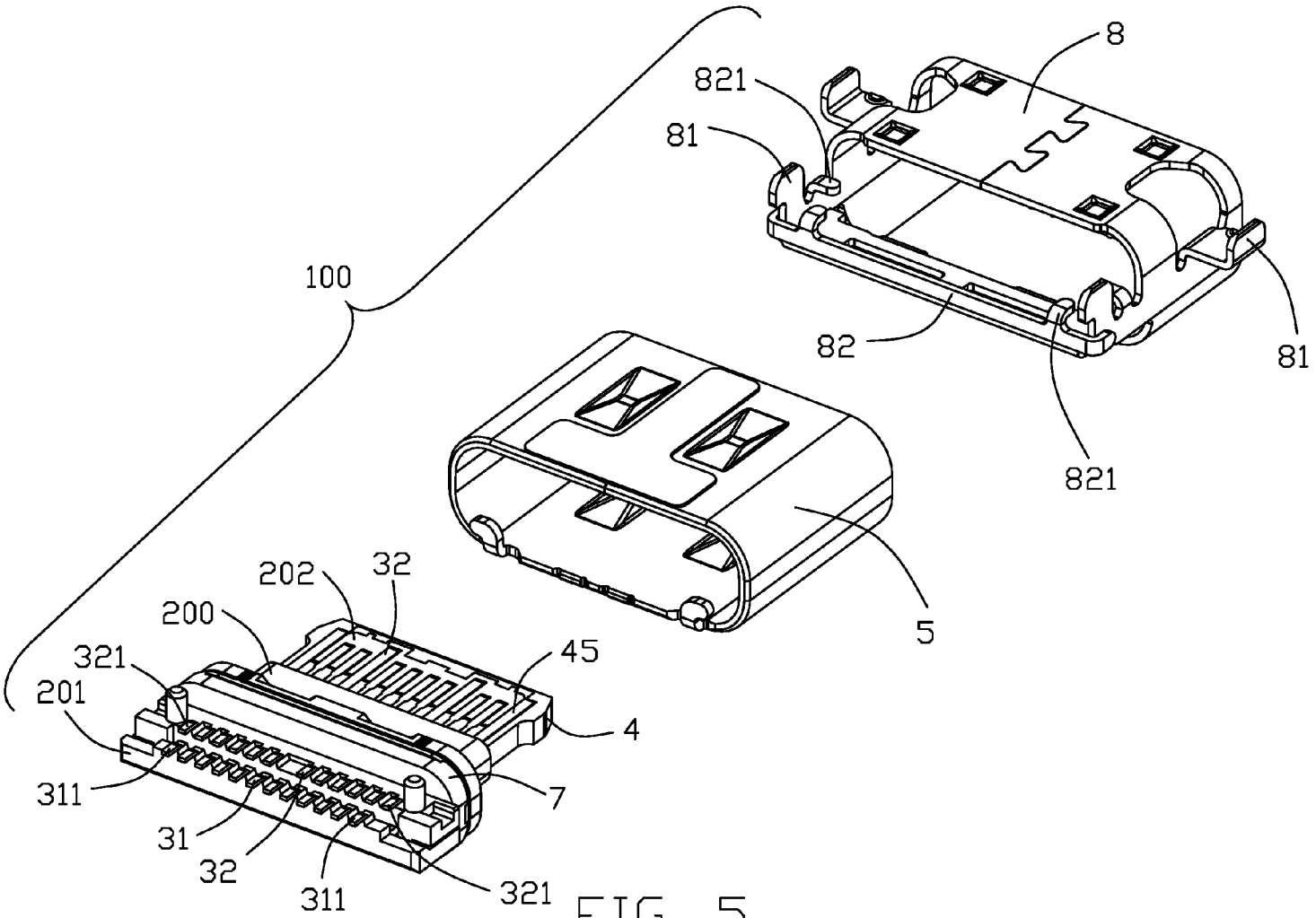
FIG. 5 is another perspective, exploded view of the electrical connector of FIG. 4.
Figure 6:
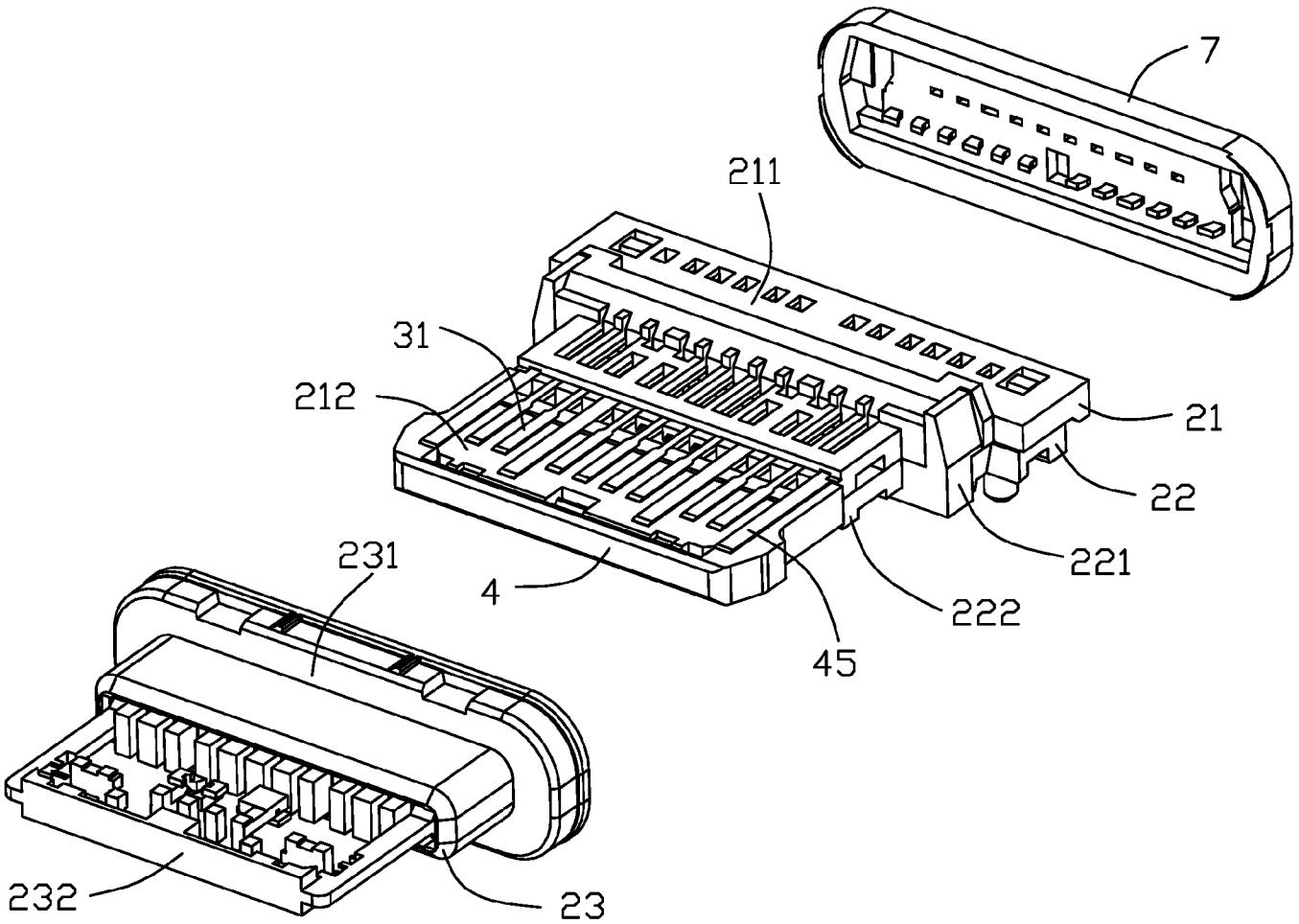
FIG. 6 is a further perspective, exploded view of FIG. 5.
Figure 7:
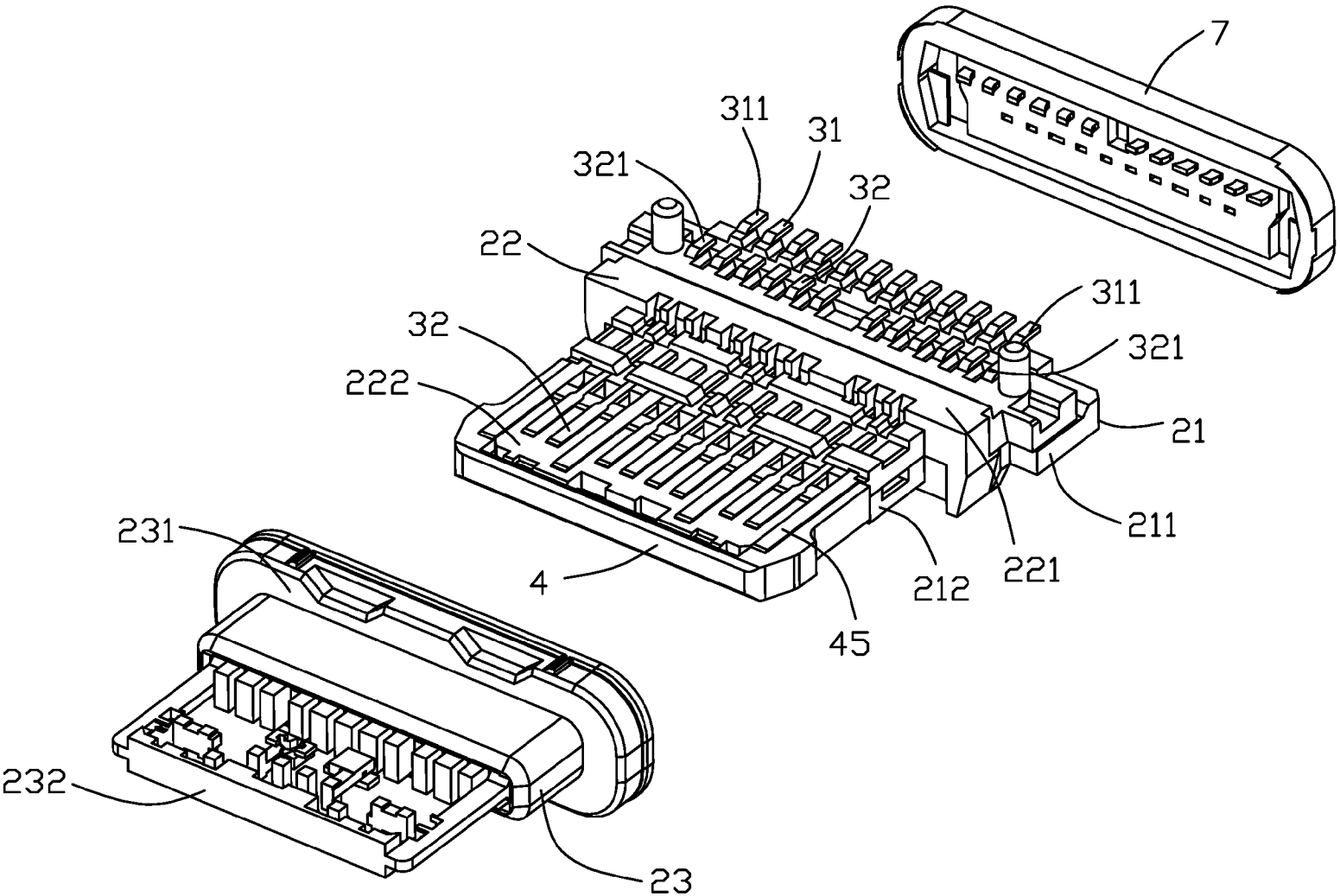
FIG. 7 is another perspective, exploded view of FIG. 6.
Figure 8:
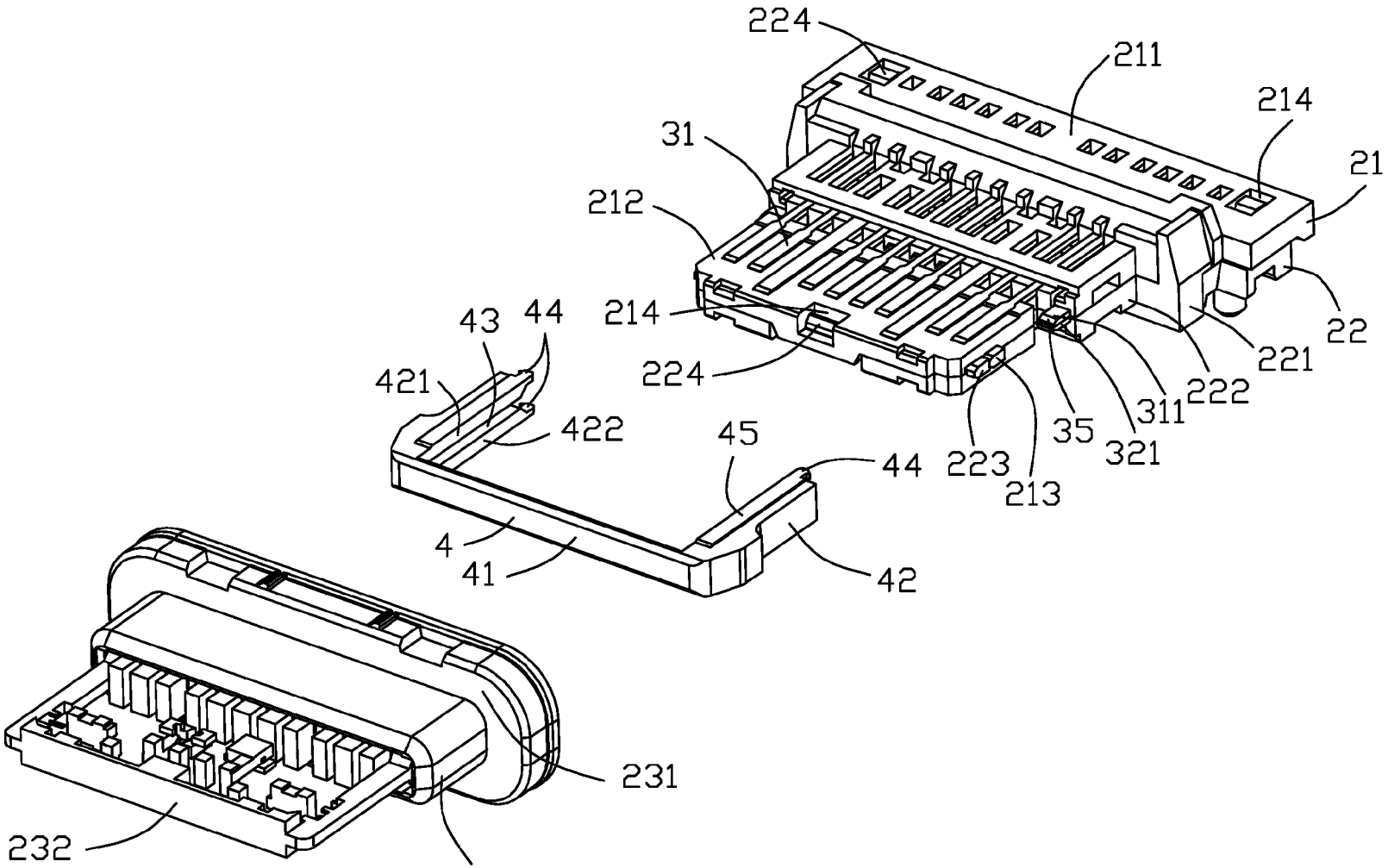
FIG. 8 is a perspective, exploded view of the electrical connector omitting a shielding shell and a metal shell thereof.
Figure 9:
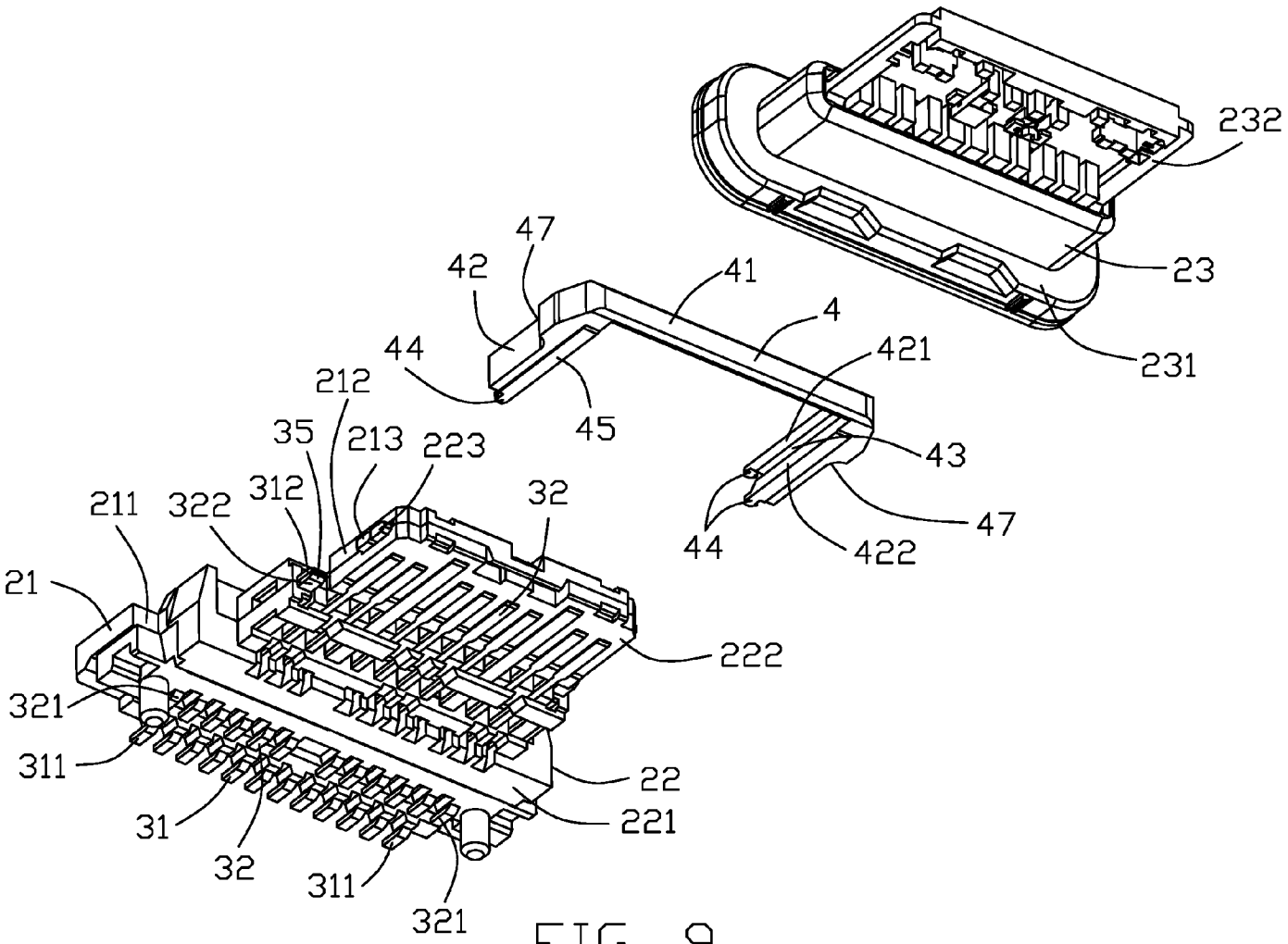
FIG. 9 is another perspective, exploded view of FIG. 8.
Figure 10:
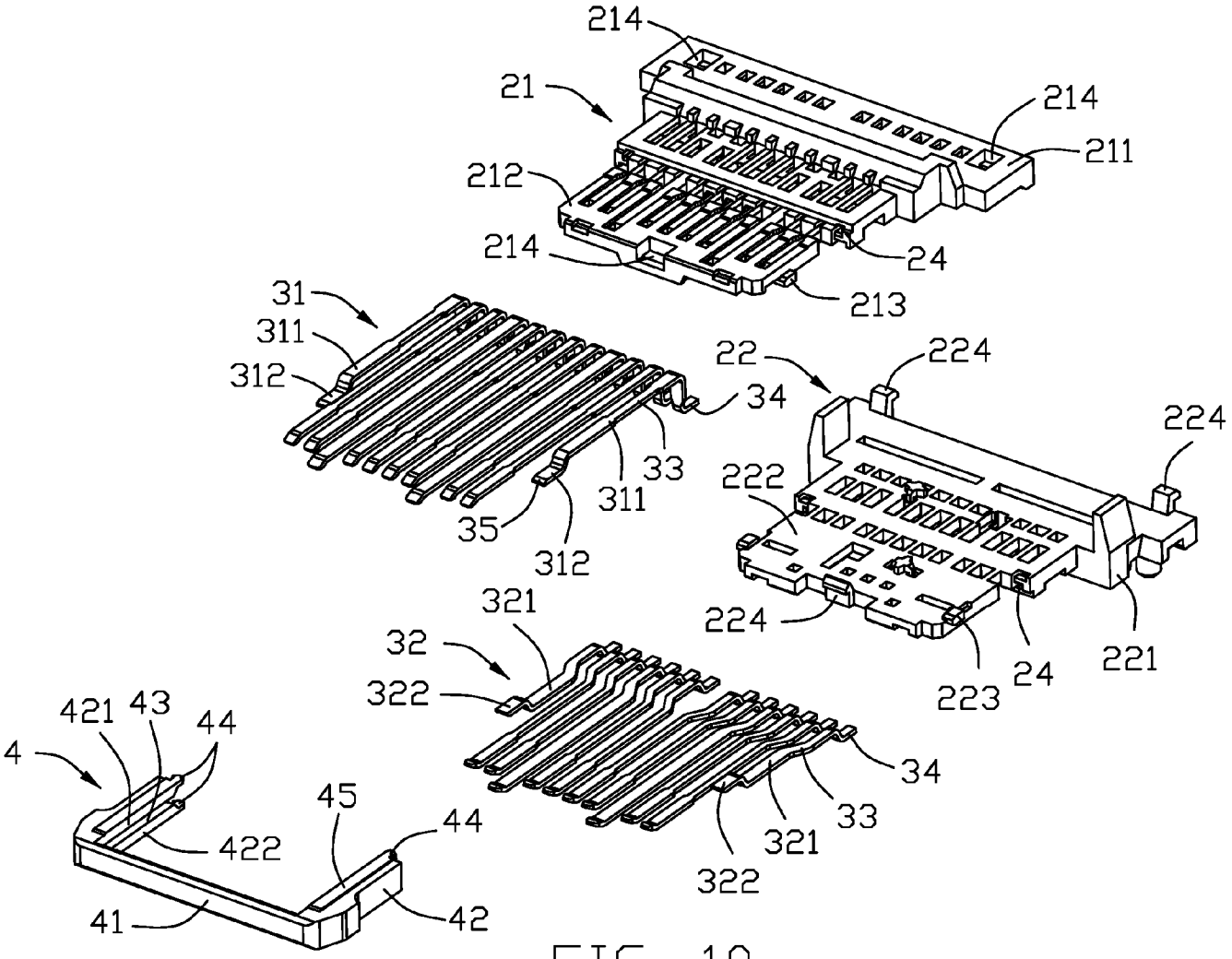
FIG. 10 is a further exploded view of FIG. 8.
Figure 11:
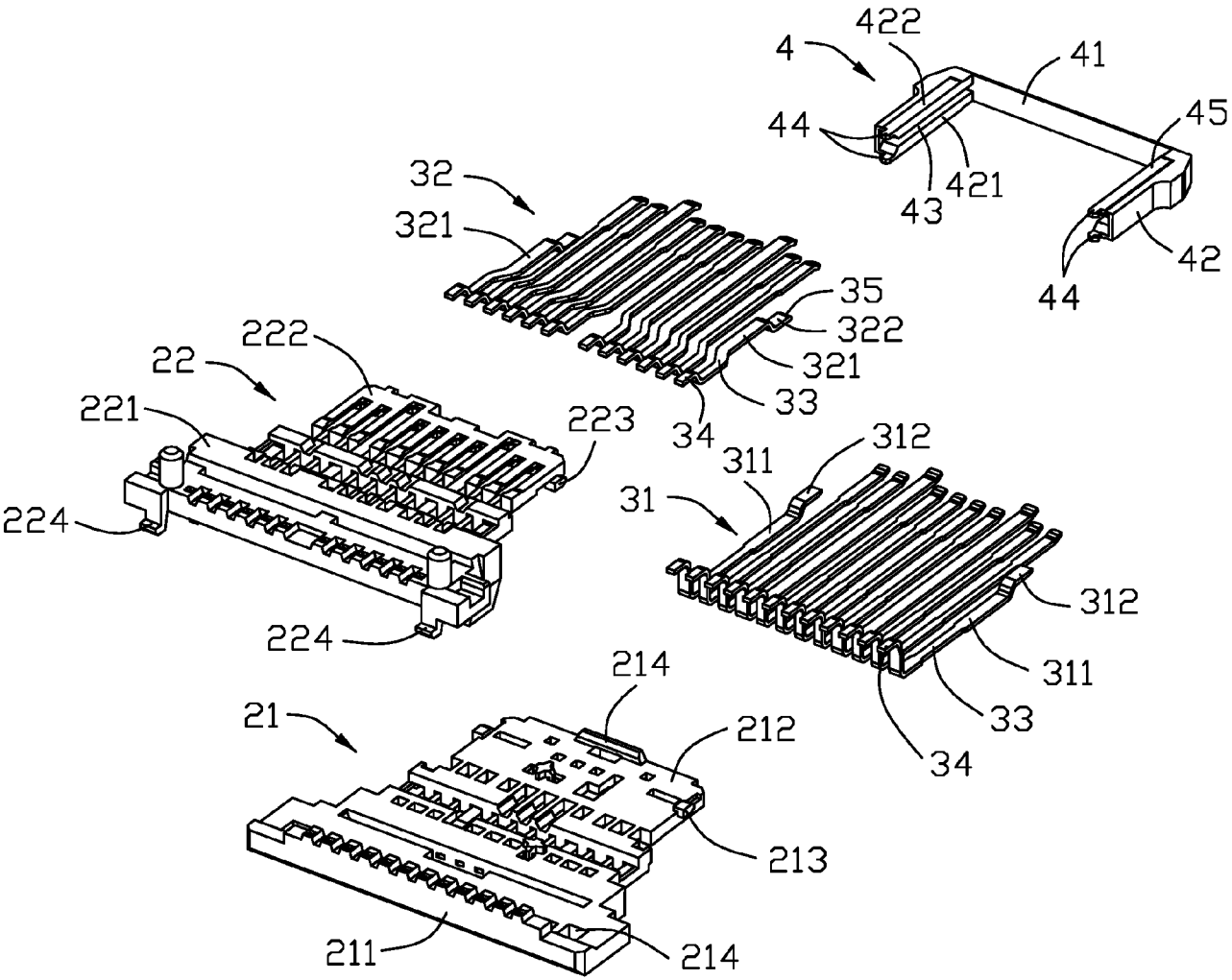
FIG. 11 is another exploded view of FIG. 10.
Figure 12:
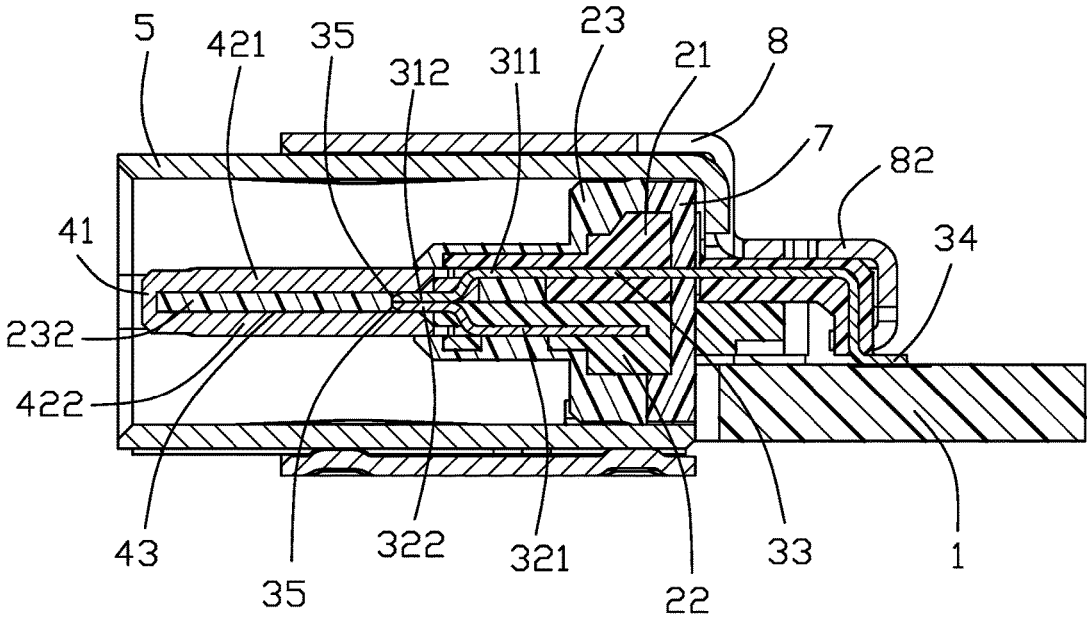
FIG. 12 is a cross-sectional view of the electrical connector along line 12-12 in FIG. 1.
Figure 13:
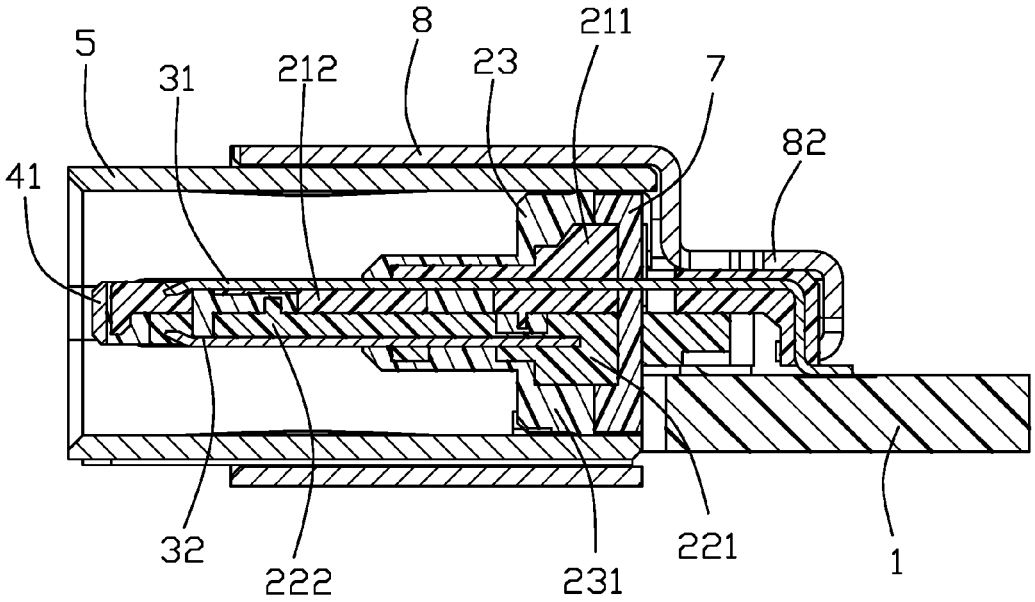
FIG. 13 is a cross-sectional view of the electrical connector along line 13-13 in FIG. 1.
Figure 14:
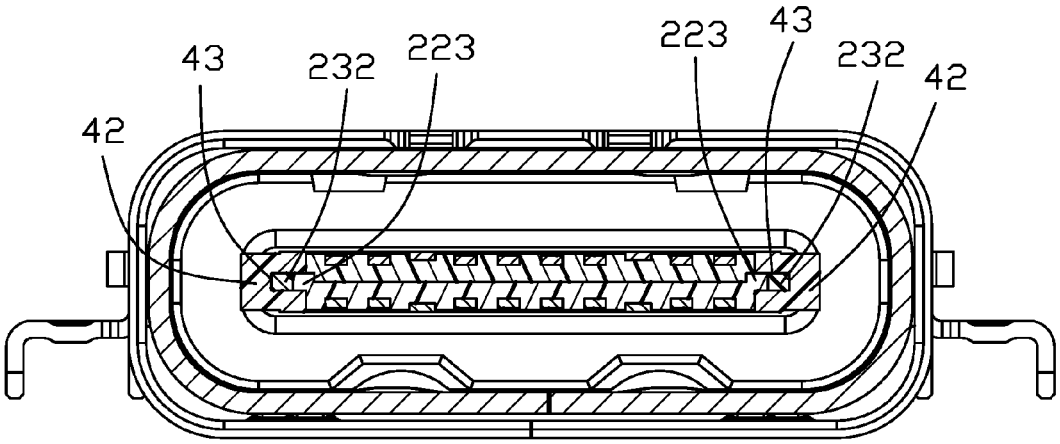
FIG. 14 is a cross-sectional view of the electrical connector along line 14-14 in FIG. 1.
Figure 15:
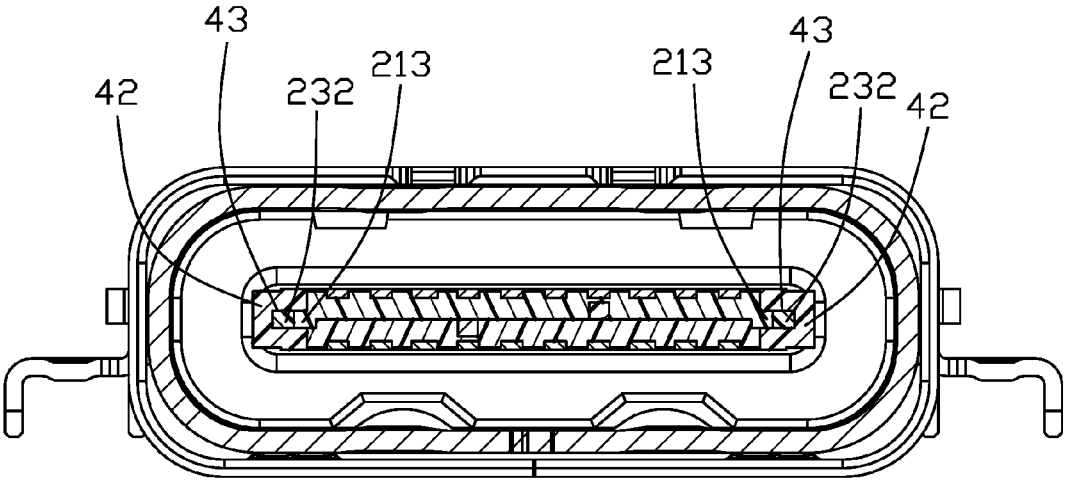
FIG. 15 is a cross-sectional view of the electrical connector along line 15-15 in FIG. 1.

Referring to FIGS. 5-7, the insulative housing 20 includes a base portion 201 and a tongue portion 202 extending upwardly from the base portion 201. The insulative housing 20 includes a first insulative body 21, a second insulative body 22 disposed in the vertical direction, and an insulator 23 accommodating the first insulative body 21 and the second insulative body 22. Referring to FIGS. 6-13, the first insulative body 21 includes a first base portion 211 and a first tongue portion 212 extending upwardly from the first base portion 211. The first tongue portion 212 has a pair of first projections 213 located at a lower surface thereof and protruding laterally. The first insulative body 21 has a number of receiving holes 214 located at two sides of the first base portion 211 and a front end of the first tongue portion 212. The second insulative body 22 includes a second base portion 221 and a second tongue portion 222 extending upwardly from the second base portion 221. The second tongue portion 222 has a pair of second projections 223 located at an upper surface thereof and protruding laterally. The second insulative body 22 has a number of bulges 224 located at two sides of the second base portion 221 and a front end of the second tongue portion 222. The bulges 224 protrude upwardly to receive in the receiving holes 214 of the first insulative body 21 along the vertical direction. The first base portion 211 and the second base portion 221 include a number of receiving grooves 24 located at a front surface thereof and respectively close to the first tongue portion 212 and the second tongue portion 222. The insulator 23 includes a protruding portion 231 and a front portion 232 extending upwardly from the protruding portion 231 and accommodating the first tongue portion 212 and the second tongue portion 222. The first base portion 211, the second base portion 221, and the protruding portion 231 commonly form the base portion 201, and the first tongue portion 212, the second tongue portion 222, and the front portion 232 commonly form the tongue portion 202.

Referring to FIGS. 4-13, the terminals 3 includes a number of first contacts 31 carried by the first tongue portion 212 and a number of second contacts 32 carried by the second tongue portion 222. The first contacts 31 and the second contacts 32 extending in a mating direction. Each of the first contacts 31 is associated with a respective one of the second contacts 32 and is positioned in reverse symmetry with respect to the second contacts 32. The first contacts 31 include at least one first grounding contact 311 and the second contacts 32 include at least one second grounding contact 321. The first grounding contact 311 has a connecting portion 33, a soldering portion 34 extending rearwardly from the first base portion 211, and a first tail/contacting portion 312. A front end of the first tail portion 312 is exposed from a gap of the first tongue portion 212. The second grounding contact 321 has a connecting portion 33, a soldering portion 34 extending rearwardly from the second base portion 221, and a second tail/contacting portion 322. A front end of the second tail portion 322 is exposed from a gap of the second tongue portion 222. The second tail portion 322 is engaged with the first tail portion 312 along the vertical direction and each of the first tail portion 312 and the second tail portion 322 has an incline portion 35 located at a front end. The incline portions 35 of the first tail portion 312 and the corresponding second tail portion 322 form a V shape and are located behind the first projection 213 along the mating direction. The first contacts 31 and the second contacts 32 are positioned to have 180 degree symmetry such that the corresponding plug connector (not shown but available by referring to U.S. Pat. No. 9,484,681), can be inserted and operatively coupled to the electrical connector 100 in either of two orientations. The soldering portion 34 of the first contacts 31 and the second contacts 32 are located at a same plane and configured in two rows. Understandably, in this embodiment, the first contacts 31 are integrally formed with the first insulative body 21 to commonly form a first/upper terminal module (not labeled) via a first stage insert-molding process, and the second contacts 32 are integrally formed with the second insulative body 22 to commonly form a second/lower terminal module (not labeled) via another first stage insert-molding process.

Referring to FIGS. 1-15, the metallic shielding plate 4 is of a U-shaped configuration and includes a bridge portion 41 attached to a front end of the first insulative body 21 and second insulative body 22 and a pair of side portions 42 extending backwardly from two sides of the bridge portion 41 and enclosing side edges of the first insulative body 21 and second insulative body 22 along the mating direction. A thickness of the bridge portion 41 is not less than that of the combination of the first tongue portion 212 and the second tongue portion 222. Each side portion 42 has an upper beam 421, a lower beam 422 located along the vertical direction with the upper beam 421, and a number of hooks 44 respectively located in an upper surface and a lower surface of the upper beams 421 and the lower beams 422 and away from the bridge portion 41. The upper beam 421 and the lower beam 422 of same side portion 42 form a sliding slot 43 therebetween. Each of the upper beams 421 and the lower beams 422 has a striping-like protrusion 45 electrically connected with grounding contacts of the mating connector and spaced from the neighboring terminals 3 along the transverse direction. In other words, the protrusion 45 is to replace the contacting section of the original outermost grounding contact for mating with the grounding contact of the mating plug connector. Notably, in this embodiment the outermost grounding contact 311, 321 forms a shortened contacting section on the tongue portion 202 compared with other terminals 3 because of the corresponding protrusion 45. The hooks 44 are received in and engaged with the receiving grooves 24 of the insulative housing 20. Notably, similar to other USB Type C receptacle connector, the metallic shielding plate 4 forms a pair of locking notches 47 on two opposite lateral sides for engagement with a pair of corresponding latches of the USB Type C plug connector.

The metal shell 8 has a number of first affixed legs 81 extending downwardly from side surfaces thereof to retain in the printed circuit board 1 and a shielding wall 82 located at a back end thereof and shielding a back end of the insulative housing 20. The shielding wall 82 has a pair of second affixed legs 821 bent inwardly and engaged with a bottom surface of the insulative housing 20.

The method of making the electrical connector 100 includes the steps of: providing a plurality of terminals, the terminals having at least a grounding contact located outermostly along a transverse direction perpendicular to a mating direction, each grounding contact having a connecting portion, a soldering portion, and a tail portion extending upwardly from the connecting portion; insert-molding an insulative housing with the terminals, the insulative housing having a base portion retaining the connecting portion and a tongue portion extending upwardly from the base portion, the tail portion exposed from a gap of the tongue portion; providing a metallic shielding plate, the metallic shielding plate having a bridge portion and a pair of side portions extending backwardly form two sides of the bridge portion; assembling the metallic shielding plate to the insulative housing along the mating direction, the bridge portion enclosing a front end of the tongue portion, the side portions electrically connected with the tail portions of the terminals; an insulator defined in insulative housing is over-molded with the metallic shielding plate; and assembling a shielding shell to enclose the insulative housing. Notably, in this embodiment the insulator 23 is integrally formed with the first insulative body 21, the second insulative body 22 and the shielding plate 4 via a second stage insert-molding process.

A first feature of the invention is to provide the metallic shielding/grounding plate/bracket 4 with the functions of not only locking with the corresponding plug connector via the locking notches 47 but also retaining the upper terminal module and the lower terminal module together via the projections 213 and 223 received within the corresponding sliding slots 43 in the vertical direction. A second feature of the invention is to have the shielding/grounding sheet/bracket 4 replace the outermost grounding terminals, in the transverse direction, on the tongue portion 202. A third feature of the invention is to have the shielding bracket 4 provide a thickened dimension in the vertical direction, i.e., the thickness direction of the tongue portion 202 for not only reinforcing the strength of the whole tongue portion 202 but also providing a superior latching and grounding effect with the corresponding metallic resilient latches of the complementary plug connector. In other words, in this embodiment, the metallic bracket 4 has the same dimension with the tongue portion 202 in the vertical direction, i.e., the thickness direction of the tongue portion 202. Understandably, the traditional USB Type C receptacle connector, as shown in U.S. Pat. No. 9,484,681, uses the metallic shielding plate located between the upper terminals and the lower terminals and such a substantial plate essentially defines a less dimension in the vertical direction, thus failing to perform the aforementioned effects. In this embodiment, the metallic shielding bracket is made via a die-casting process so as to have thickened structures while the traditional shielding shell is made via a stamping process so as to only have a uniformed small thickness thereof.

However, the disclosure is illustrative only, changes may be made in detail, especially in matter of shape, size, and arrangement of parts within the principles of the invention.

What is claimed is:

1. An electrical connector comprising:

an insulative housing defining a base portion and a tongue portion forwardly extending from the base portion in a front-to-back direction;

a plurality of terminals disposed in the insulative housing and including at least one grounding contact, the at least one grounding contact having a connecting portion retained in the base portion, a soldering portion extending backwardly from the base portion, and a contacting portion extending forwardly from the connecting portion;

a metallic shielding brackets affixed to a front portion of the tongue portion and having a pair of side portions covering two opposite side edges of the tongue portion, equipped with a pair of locking notches for engagement with a complementary plug connector, and electrically and mechanically connected with the contacting portion of the at least one grounding contact so as to cooperate with said at least one grounding contact to function as a traditional grounding terminal which is adapted to be coupled to another grounding terminal of a complementary plug connector during mating;

and a shielding shell attached to the insulative housing; and wherein each of the side portions has an upper beam, a lower beam, and a sliding slot located between the upper beam and the lower beam and the contacting portions slide into and are received in the sliding slots.

2. The electrical connector as claimed in claim 1, wherein the insulative housing has an insulator over-molded with the tongue portion and the metallic shielding bracket.

3. The electrical connector as claimed in claim 1, wherein said metallic shielding bracket includes a transverse bridge portion enclosing a front end of the tongue portion and said side portions extend backwardly from two ends of the bridge portion.

4. The electrical connector as claimed in claim 1, wherein each of the upper beams and the lower beams has a pair of protrusions located at an upper surface and a lower surface thereof, respectively, and the protrusions are distanced from neighboring terminals along a transverse direction for replacing grounding contact for mating with a complementary plug connector.

5. The electrical connector as claimed in claim 1, wherein each of the side portions has a pair of hooks located at the upper beams and the lower beams, and the hooks extend into and are received in the base portion.

6. The electrical connector as claimed in claim 1, wherein the insulative housing has a first insulative body and a second insulative body located in the vertical direction, the tongue portion has a first tongue portion located at the first insulative body and a second tongue portion located the second insulative body, the first tongue portion has a pair of first projections located at two sides thereof, the second tongue portion has a pair of second projections located at two sides thereof and in front of the first projections, and the first projections and the second projections slide in the sliding slots.

7. The electrical connector as claimed in claim 5, wherein the terminals include a plurality of first contacts and a plurality of second contacts positioned to have 180 degree symmetry with the first contacts, the first contacts have a pair of first grounding contacts, the second contacts have a pair of second grounding contacts, the contacting portions have a pair of first contacting portions located at the first grounding contacts and a pair of second contacting portions located at the second grounding contacts, each first contacting portion is engaged with the upper beam, and the second tail portion is engaged with the lower beam.

8. The electrical connector as claimed in claim 1, wherein the side portions of the metallic shielding bracket defines a dimension, along a vertical direction perpendicular to said front-to-back direction, similar to a thickness of said tongue portion in said vertical direction for reinforcement consideration.

9. A method of making an electrical connector, comprising the steps of: providing a plurality of terminals, the terminals having a pair of grounding contacts located at two opposite outermost positions along a transverse direction perpendicular to a mating direction, each of the grounding contacts having a connecting portion, a soldering portion, and a contacting portion extending from the connecting portion;

insert-molding an insulative housing with the terminals, the insulative housing having a base portion retaining the connecting portion and a tongue portion extending from the base portion, the contacting portion exposed in the tongue portion;

providing a metallic shielding bracket with a pair of side portions each equipped with a locking notch for mating with a complementary plug connector; and attaching the pair of side portions to a pair of opposite lateral sides of the tongue portion; wherein the side portions mechanically and electrically connect to the contacting portions of the corresponding grounding contacts, respectively, for functioning as a grounding terminal to mate with another grounding terminal of a complementary plug connector during mating; and wherein each of the side portions has an upper beam, a lower beam, and a sliding slot located between the upper beam and the lower beam, and the contacting portions slide into and are received in the sliding slots.

10. The method as claimed in claim 9, wherein said insulative housing and said plurality of terminals include a first insulative body integrally formed with a plurality of first contacts via a first stage insert-molding process to form a first terminal module, and a second insulative body integrally formed with a plurality of second contacts via another first stage insert-molding process to form a second terminal module, and said metallic shielding bracket retaining said first terminal module and said second terminal module together in a vertical direction, and an insulator applied upon the assembled first terminal module, second terminal module and metallic shielding bracket via a second stage insert-molding process to finalize said insulative housing.

11. The method as claimed in claim 10, wherein each of said side portions forms a sliding slot to receive projections of the first insulative body and the second insulative body for retaining the first insulative body and the second insulative body together in the vertical direction, and said metallic shielding bracket moves rearwardly along the mating direction when assembled to the tongue portion.

12. The method as claimed in claim 9, wherein a dimension of each of said side portions in a vertical direction perpendicular to both said transverse direction and said mating direction, is similar to a thickness of the tongue portion in said vertical direction for reinforcement consideration.

13. The method as claimed in claim 9, wherein said shielding bracket defines a U-shaped structure including a transverse bridge portion covering a front end of the tongue portion, and said pair of side portions extend rearwardly from two opposite lateral ends of said bridge portion.

14. An electrical connector comprising:

a first terminal module including a plurality of first contacts integrally formed with a first insulative body;

a pair of first projections respectively formed on two opposite lateral sides of a first tongue portion of the first terminal module;

a second terminal module including a plurality of second contacts integrally formed with a second insulative body;

a pair of second projections respectively formed on two opposite lateral sides of a second tongue portion of the second terminal module;

a metallic shielding bracket including at least a pair of side portions respectively defining a pair of interior sliding slots along a front-to-back direction and a pair of exterior locking notches for mating with a complementary plug connector; wherein said first terminal module and said second terminal module are tightly stacked with each other in a vertical direction perpendicular to said front-to-back direction, and said pair of side portions are attached upon the corresponding lateral sides of said first tongue portion and those of said second tongue portion to receive the corresponding first projections and second projections therein so as to retain the first terminal module and said second terminal module together in the vertical direction.

15. The electrical connector as claimed in claim 14, wherein by means of the corresponding sliding slot, each of said first projections experiences a downward force while each of second projections experiences an upward force so as to urge the first insulative body and the second insulative body toward each other in the vertical direction for retention consideration.

16. The electrical connector as claimed in claim 15, wherein the first projection is aligned with the corresponding second projection in the front-to-back direction in an offset manner.

17. The electrical connector as claimed in claim 14, wherein a dimension of each side portions in the vertical direction is similar to a sum thickness of the first tongue portion and the second tongue portion in the vertical direction for reinforcement consideration.

18. The electrical connector as claimed in claim 14, wherein each of said side portions defines a portion positioned at an outermost position of the corresponding first contact or second contact to function as a grounding terminal for coupling to another grounding terminal of a complementary plug connector during mating.

19. The electrical connector as claimed in claim 14, wherein said shielding bracket defines a U-shaped structure including a transverse bridge portion covering a front end of the tongue portion, and said pair of side portions extend rearwardly from two opposite lateral ends of said bridge portion.

* * * * *